United States Patent [19]

Ishii

[11] 4,432,165

[45] Feb. 21, 1984

[54] WINDOW REGULATOR FOR AN AUTOMOTIVE VEHICLE

[75] Inventor: Kinichi Ishii, Yokohama, Japan

[73] Assignee: Kabushiki Kaisha Johnan Seisakusho, Japan

[21] Appl. No.: 324,091

[22] Filed: Nov. 23, 1981

[30] Foreign Application Priority Data

Dec. 15, 1980 [JP] Japan ..... 55-179933[U]

[51] Int. Cl.[3] ..... E05F 11/44

[52] U.S. Cl. ..... 49/351; 49/348; 49/374

[58] Field of Search ..... 49/348–351, 49/374, 375

[56] References Cited

U.S. PATENT DOCUMENTS 2,409,068 10/1946 Roethel ..... 49/351 X
3,061,363 10/1962 Martinez ..... 49/351

FOREIGN PATENT DOCUMENTS 411436 6/1934 United Kingdom .
589188 6/1947 United Kingdom .
683163 11/1952 United Kingdom .
840299 7/1960 United Kingdom .
1013187 12/1965 United Kingdom .
1035980 7/1966 United Kingdom .
1386528 3/1975 United Kingdom .
1423800 2/1976 United Kingdom .

*Primary Examiner*—Kenneth Downey
*Attorney, Agent, or Firm*—McGlew and Tuttle

[57] ABSTRACT

A window regulator for an automotive vehicle for moving a window pane up and down comprises a plurality of fixed sliders, in place of rotating rollers, in addition to the conventional elements such as a main arm, two subarms, a movable guide rail, a fixed guide rail, a rack and a pinion, etc. The respective arms used for the window regulator according to the present invention include a bent portion at one end thereof in which a slider-fixing portion and a pair of tabs are formed, respectively. The sliders include a slot formed at the center thereof. The slider-fixing portion of each arm is inserted into the slot of a slider so that the tab extend slightly therethrough, and then the tabs are bent to fix the slider on the end of the arm.

6 Claims, 4 Drawing Figures

WINDOW REGULATOR FOR AN AUTOMOTIVE VEHICLE

FIELD OF THE INVENTION

The present invention relates generally to a window regulator for an automotive vehicle, and more specifically to a structure of a window regulator for an automotive vehicle including a plurality of slidable rollers fixedly connected to a main arm and two subarms.

DESCRIPTION OF THE PRIOR ART

The background of the present invention will be explained with respect to its application to the window regulator for an automotive vehicle.

As is well known, a window regulator is used for an automotive vehicle in order to move a window pane provided for a vehicle door up and down. The prior-art window regulator for an automotive vehicle usually uses a link mechanism and therefore includes a plurality of rollers rotatably moved along appropriate guide rails. The roller is rotatably supported by a roller pin fixed to an arm. In order to install such rollers in a window regulator, various troublesome steps are required, such as fixing the roller pin on the arm, mounting the roller with the roller pin passed through a central hole of the roller, and clamping the end of the roller pin to hold the roller thereon.

The arrangement of the prior-art window regulator for an automotive vehicle will be described in more detail hereinafter with reference to the attached drawings under DETAILED DESCRIPTION OF THE PREFERRED EMBODIMENTS.

SUMMARY OF THE INVENTION

With these problems in mind, therefore, it is the primary object of the present invention to provide a window regulator for an automotive vehicle which includes no rotatable rollers, that is, no roller pins.

To achieve the above-mentioned object, the window regulator for an automotive vehicle according to the present invention comprises a plurality of fixed rollers slidably moved along a movable guide rail and a fixed guide rail in addition to conventional elements used with window regulators.

Further in this case, a main arm and two subarms, which constitute, in combination, an X-arm-type window regulator, include a bent portion at one end thereof, respectively, in which a slider-fixing portion is formed with two tabs at the extreme end thereof.

The window regulator according to the present invention can improve productivity of the window regulator and thus reduce manufacturing cost.

BRIEF DESCRIPTION OF THE DRAWINGS

The features and advantages of the window regulator according to the present invention will be more clearly appreciated from the following description taken in conjunction will the accompanying drawings in which like reference numerals designate corresponding elements in which.

DETAILED DESCRIPTION OF THE PREFERRED EMBODIMENTS

To facilitate understanding of the present invention, a brief reference will be made to a prior-art window regulator for an automotive vehicle, with reference to the attached drawings.

Figure 1:
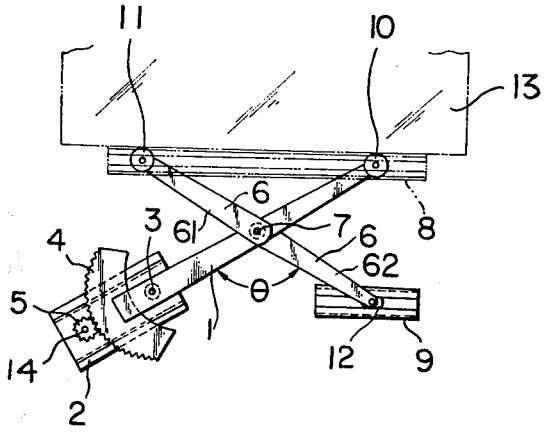
FIG. 1 PRIOR ART
FIG. 1 is a front view showing a sample prior-art window regulator for an automotive vehicle.

In FIG. 1, the reference numeral 1 denotes a main arm, one end of which is moved along a movable channel-shaped guide rail 8 with a roller 10 rotatably mounted on the extreme end thereof and the other end of which is rotatably supported by a pin 3 fixed on a base member 2 fixed to a vehicle door (not shown). The reference numeral 61 denotes a first subarm, one end of which moves along the movable channel-shaped guide rail 8 with another roller 11 rotatably mounted on the extreme end thereof and the other end of which is rotatably supported by an arm pin 7 fixed at the central position of the main arm 1. The reference numeral 62 denotes a second subarm, one end of which moves along a fixed channel-shaped guide rail 9 with another roller 12 rotatably mounted on the extreme end thereof and the other end of which is rotatably supported by the arm pin 7 fixed at the central position of the main arm 1 coaxially with the end of the first subarm 61. The reference numeral 4 denotes a fan-shaped rack fixed to the main arm 1. The rack 4 is rotated clockwise or counterclockwise by a pinion 5 rotatably supported by a pinion shaft 14 fixed on the base 2 so as to gear with the rack 4.

In the prior-art window regulator thus constructed, when the pinion 5 is rotated clockwise or counterclockwise, the main arm 1 swings with the rack 4 about the pin 3. Therefore, the main arm 1 and the first and second subarms 61 and 62 are pivotted, changing the angle $\theta$ subtended by the main arm 1 and the subarm 62. Since the roller 12 rotatably supported by the end of the second subarm 62 moves along the fixed guide rail 9 without changing its vertical position, the movable guide rail 8 within which two rollers 10 and 11 are rotatably engaged is moved up and down, so that the window pane 13 is also moved up and down in conjunction with the up-and-down movement of the movable guide rail 8.

In such a prior-art window regulator, however, since the rollers 10, 11, 12 are rotatably mounted on the main arm or the two subarms with appropriate roller pins, various difficult, troublesome steps are required for installing the rollers onto the arms, for instance, such as fixing the roller pins to the arms, fitting the rollers to the roller pins, and clamping the ends of the roller pins.

In view of the above description, reference is now made to a preferred embodiment of the window regulator for an automotive vehicle according to the present invention, in which the rollers slide rather than roll when the window pane is moved up and down.

Figure 2:
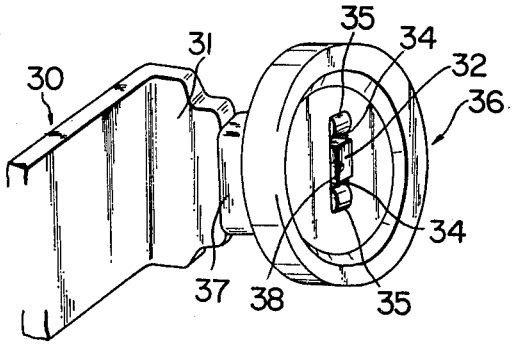
FIG. 2 is a perspective view showing a state in which a roller is mounted to the bent portion of one arm.
Figure 3:
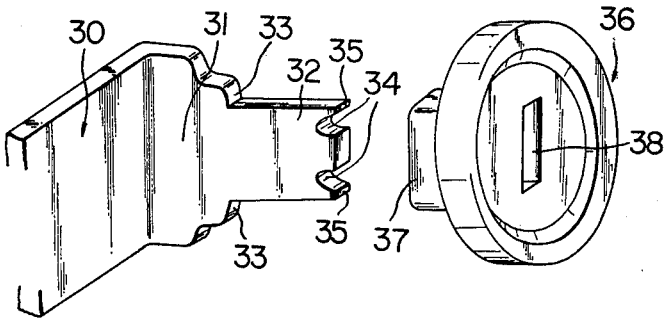
FIG. 3 is a perspective, exploded view of FIG. 2.
Figure 4:
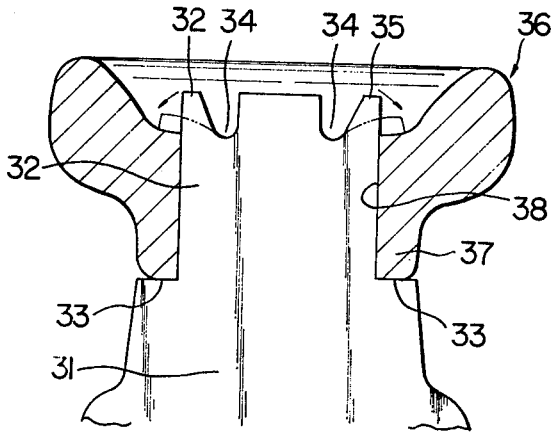
FIG. 4 is a cross-sectional view showing a roller mounted to the bent portion of one arm.

With reference to FIGS. 2, 3 and 4, the end portion of an arm 30 according to the present invention, which can be any or all, in combination, of the main arm 1, or the subarms 61 and 62, is bent at approximately a right angle with respect to the arm itself. The bent portion 31 is formed with a narrowed slider-fixing portion 32 having shoulder portions 33 on either side thereof to support the boss portion 37 of a slider 36. At the extreme end of the slider-fixing portion 32, two cutouts 34 on the free end surface of the slider-fixing portion 32 define tabs 35 which can be bent to clamp the slider 36 to the slider-fixing portion 32 after being inserted thereon.

On the other hand, the slider 36 according to the present invention is formed with a slot 38 at the center thereof and penetrating therethrough, so that the slider-fixing portion 32 can be passed through the slot 38, with the tabs 35 extending partially out of the slot 38.

Therefore, when the window regulator according to the present invention is to be assembled, first the slider 36 is fitted to the slider-fixing portion 32 formed at the bent portion 31 of the arm 30 with the slider-fixing portion 32 passing through the slot 38, and then the two tabs 35 defined by the two cutouts 34 are deformed outwardly, as depicted by the dotted lines in FIG. 4, in order to fix the slider 36 to the arm 30.

The above-mentioned bent portion 31 of the arm 30 including the slider-fixing portion 32, and the two cutouts 34 can be formed by a single press-machining operation.

The slider 36 thus fixed to the arm 30 can slidably move along the movable or fixed channel-shaped guide rail in order to move the window glass up and down. In this embodiment, since the main arm and the two subarms swing, changing the angle $\theta$ subtended by the respective arms (in FIG. 1), the contact point between the slider and the guide rail is not always kept at the same position, but changes slightly. Therefore, the slider can withstand considerable use with relatively little wear.

Further, in this embodiment, it is desirable to use sliders made of a material with a relatively low coefficient of friction and a relatively high hardness, such as synthetic resin.

As described above, in the window regulator according to the present invention, since no rotatable rollers, and therefore no roller pins, are used, it is possible to reduce the number of parts, to simplify the regulator assembly, and thus to reduce the manufacturing cost in comparison with the case where roller pins are used conventionally. Further, in the window regulator according to the present invention, since there exists no serious difficulty in moving the window pane up and down even if the rollers do not rotate, a remarkable, practical effect can be achieved.

It will be understood by those skilled in the art that the foregoing description is terms of preferred embodiments of the present invention wherein various changes and modifications may be made without departing from the spirit and scope of the invention, as is set forth in the appended claims.

What is claimed is:

1. A window regulator for an automotive vehicle for moving a window pane for a vehicle door up and down, comprising:

(a) a movable guide rail (8) attached to a lower edge of the window pane;

(b) a fixed guide rail (9) fixed to the vehicle door;

(c) a main arm (1), a first end of which moves along said movable guide rail and a second end of which is pivotably supported on the vehicle door;

(d) a first subarm (61), a first end of which moves along said movable guide rail and a second end of which is pivotably supported at a central portion of said main arm;

(e) a second subarm (62), a first end of which moves along said fixed guide rail and a second end of which is pivotably supported at the central portion of said main arm coaxially with said first subarm; and (f) a plurality of sliders (36) fixedly connected to the respective first ends of said main arm, said first subarm, and said second subarm so as to be slidable along said movable guide rail and said fixed guide rail, said main arm, said first subarm and said second subarm each include at the first end thereof, respectively, a bent portion (31) having a slider-fixing portion (32) formed with a pair of shoulder portions (33) on either side thereof for supporting said slider and a pair of bendable tabs (35) at a free end surface thereof for fixing said slider thereto.

2. A window regulator for an automotive vehicle for moving a window pane for a vehicle door up and down as set forth in claim 1, wherein said slider is formed with a slot (38) at a center thereof through which said slider-fixing portion formed in the bent portion of said arm is passed when said slider is fixed to said arm by bending said bendable tabs.

3. A window regulator for an automotive vehicle for moving a window pane for a vehicle door up and down as set forth in claim 1, wherein said sliders are made of materials having a relatively small coefficient of friction and a relatively high hardness.

4. A window regulator for an automotive vehicle for moving a window pane for a vehicle door up and down as set forth in claim 3, wherein the material for said sliders is synthetic resin.

5. An improved window regulator for an automotive vehicle for moving a window pane for a vehicle door up and down which includes:

a movable guide rail (8) attached to the lower edge of the window pane;

a fixed guide rail (9) fixed to the vehicle door;

a main arm (1), a first end of which moves along said movable guide rail and a second end of which is pivotably supported on the vehicle door;

a first subarm (61), a first end of which moves along said movable guide rail and a second end of which is pivotably supported at a central portion of said main arm; and a second subarm (82), a first end of which moves along said fixed guide rail and a second end of which is pivotably supported at the central portion of said main arm coaxially with said first subarm;

the improvement which comprises a plurality of sliders (36) fixedly connected to the respective first ends of said main arm, said first subarm, and said second subarm so as to be slidable along said movable guide rail and said fixed guide rail;

said main arm, said first subarm and said second subarm each including a bent portion (31) at the first end thereof, respectively, each bent portion having a slider-fixing portion (32) having a pair of shoulder-portions (33) on either side thereof for supporting said slider, the slider-fixing portion (32) having a pair of bendable tabs at the free end surface thereof for fixing said slider thereto.

6. An improved window regulator for an automotive vehicle for moving a window pane for a vehicle door up and down as set forth in claim 5, wherein said slider is formed with a slot (38) at the center thereof through which the slider-fixing portion formed in the bent portion of said arm passes when said roller is fixed to said arm.

* * * * *